US006152445A

United States Patent [19]

Hirota et al.

[11] Patent Number: 6,152,445

[45] Date of Patent: Nov. 28, 2000

[54] SHEET CONVEYING APPARATUS AND METHOD WHEREIN THE SHEET IS FED WITHOUT CONTACTING THE DISCHARGE LAYER

[75] Inventors: Kazuhiro Hirota; Hisao Hosoya; Satoru Endo, all of Hachioji; Mamoru Tomotsune, Asaka; Yuji Kanazawa, Musashino; Kazuyoshi Omi, Kawagoe, all of Japan

[73] Assignee: Konica Corporation, Japan

[21] Appl. No.: 09/206,847

[22] Filed: Dec. 7, 1998

[30] Foreign Application Priority Data

Dec. 19, 1997 [JP] Japan ..... 9-350765

[51] Int. Cl.[7] ..... B65H 29/30

[52] U.S. Cl. ..... 271/315; 271/208; 271/185; 271/186; 428/630; 361/213

[58] Field of Search ..... 271/208, 186, 271/185; 428/630; 361/213

[56] References Cited

U.S. PATENT DOCUMENTS

| | | | |
|---|---|---|---|
| 3,926,570 | 12/1975 | Wilks et al. | 428/630 X |
| 3,955,022 | 5/1976 | Sands | 428/95 |
| 4,474,365 | 10/1984 | DiBlasio | 271/3 |
| 4,967,661 | 11/1990 | Duarte | 271/195 X |
| 5,037,581 | 8/1991 | Saitoh et al. | 252/518 |
| 5,501,899 | 3/1996 | Larkin | 428/288 |
| 5,581,289 | 12/1996 | Firl et al. | 347/104 |
| 5,740,006 | 4/1998 | Larkin | 361/213 |
| 5,842,695 | 12/1998 | Mc Veigh | 271/187 |
| 5,843,567 | 12/1998 | Swift et al. | 428/221 |
| 5,893,558 | 4/1999 | Konig et al. | 271/264 |

FOREIGN PATENT DOCUMENTS

| | | | |
|---|---|---|---|
| 0673868 | 9/1995 | European Pat. Off. . | |
| 0817545 | 7/1998 | European Pat. Off. . | |
| 2309075 | 8/1974 | Germany . | |
| 406056301 | 3/1994 | Japan | 271/208 |
| 291365 | 12/1996 | Japan | 271/208 |

OTHER PUBLICATIONS

European Search Report EP 98 12 3405.
EPO—Patent Abstracts of Japan, Publication #57027272.
EPO—Patent Abstracts of Japan, Publication #07026069.
EPO—Patent Abstracts of Japan, Publication #06127713.
EPO—Patent Abstracts of Japan, Publication #07235392.
EPO—Patent Abstracts of Japan, Publication #57082859.
EPO—Patent Abstracts of Japan, Publication #04199174.

*Primary Examiner*—Christopher P. Ellis
*Assistant Examiner*—Richard Ridley
*Attorney, Agent, or Firm*—Jordan B. Bierman; Bierman, Muserlian and Lucas

[57] ABSTRACT

A sheet conveyance apparatus includes a guide for the recording sheet formed by a discharging layer. The layer includes an electrically grounded conductive substrate and an organic conductive fiber thereon. The surface of the guide is in close proximity to the surface of the recording sheet.

10 Claims, 9 Drawing Sheets

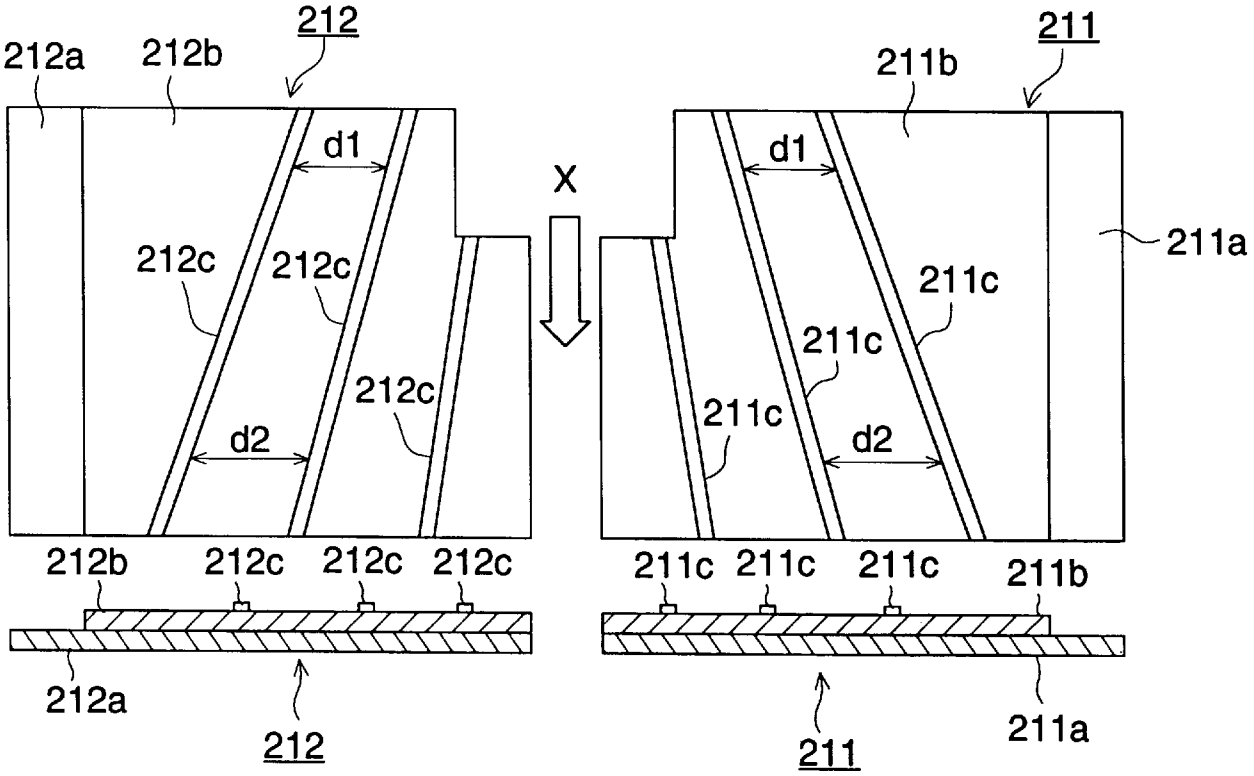
FIG. 9 ( a )
FIG. 9 ( b )

SHEET CONVEYING APPARATUS AND METHOD WHEREIN THE SHEET IS FED WITHOUT CONTACTING THE DISCHARGE LAYER

BACKGROUND OF THE INVENTION

The present invention relates to a sheet conveying apparatus and sheet conveying method, and specifically to a conveying apparatus and conveying method of recording sheet in an image forming apparatus such as a copier, printer, facsimile, or similar apparatus.

In the sheet conveyance in an image forming apparatus such as a copier, printer or facsimile, one of problems is a static electricity problem which is generated by triboelectric charging, or charging caused by peeling while conveying the sheet. A conveyance failure such as sheet jamming, skewing, deviation of conveyance timing, or sheet misalignment in the delivery sheet section, and further, a failure such as image quality lowering are caused by static electricity.

Conventionally, in order to prevent the generation of such static electricity, a discharging brush is made to be in contact with the conveying sheet.

However, at the present, the static electricity can not be sufficiently discharged by the discharging brush, and failures as described above are not perfectly prevented, therefore, satisfactory stability and reliability are not obtained in the sheet conveying section.

As a finishing apparatus of recording sheet in the image recording apparatus, a recording sheet reversing apparatus using a drum-like recording sheet reversing means is disclosed in Japanese Patent Publication Open to Public Inspection Nos. 85662/1996 and 85663/1996. In this recording sheet reversing apparatus, the recording sheet is reversed by turning a drum after the leading edge of the recording sheet is held by the drum, and the recording sheet is reversed such that trailing edge of the recording sheet is separated from the peripheral surface of the drum after being conveyed along the peripheral surface of the drum, and thus, the sheet reversing process is completed. In such the recording sheet reversing apparatus, the charging caused by peeling occurs when the recording sheet is separated from the drum, which results in a trouble in the recording sheet conveyance, and it is difficult to fully eliminate the static electricity by discharging using the discharging brush.

That is, as described above, such the problem is specifically conspicuous in the drum-like recording sheet reversing apparatus that it is difficult to fully discharge the static electricity by the discharging brush. The above-described trouble in the recording sheet conveyance in the recording sheet reversing apparatus is an example of problems which can not be fully solved by such the conventional antistatic method using the discharging brush.

SUMMARY OF THE INVENTION

Accordingly, an object of the present invention is to improve the conventional antistatic method which can not fully eliminate the static electricity up to now, and to provide a recording sheet conveying apparatus and method onto which a satisfactory antistatic method is applied.

The object of the present invention is attained by the following: a sheet conveyance apparatus including: guiding means for guiding a recording sheet, wherein the guiding means is formed by a discharging layer including a conductive substrate which is electrically grounded and an organic conductive fiber provided on the conductive substrate, and a surface of the guiding means is arranged to be in close proximity to a surface of the recording sheet.

BRIEF DESCRIPTION OF THE DRAWINGS

FIGS. 9(*a*) and 9(*b*) are a plan view and a sectional view of the guiding plate, in which the guide plate is developed into a plane.

DETAILED DESCRIPTION OF THE PREFERRED EMBODIMENT (1) Recording sheet reversing processing apparatus FIG. 1 shows an outline of a copier in which a recording sheet conveying apparatus of an example of the present invention is mounted, and which is structured by an image recording section 101, a sheet feed section 102, an automatic document feeding apparatus 103, and a recording sheet processing apparatus 200. A document is automatically fed from the automatic document feeding apparatus 103, an image is recorded on the recording sheet conveyed from the sheet feed section 102 in the image recording section 101, and the recording sheet is delivered to the recording sheet processing apparatus 200. In the recording sheet processing apparatus 200, the recording sheet is delivered onto a straight delivery sheet tray 205 or a reversed delivery sheet tray 206 according to switching of a recording sheet delivery mode.

FIG. 2 is a perspective view of the recording sheet processing apparatus according to an example of the present invention. The recording sheet P delivered from the recording section 101 is received by a pair of conveyance rollers 203, and is reversed face down by a reversing drum 201, and after that, stacked onto a stacking table 302, and is delivered toward the right down direction by a delivery member 204.

Figure 1:
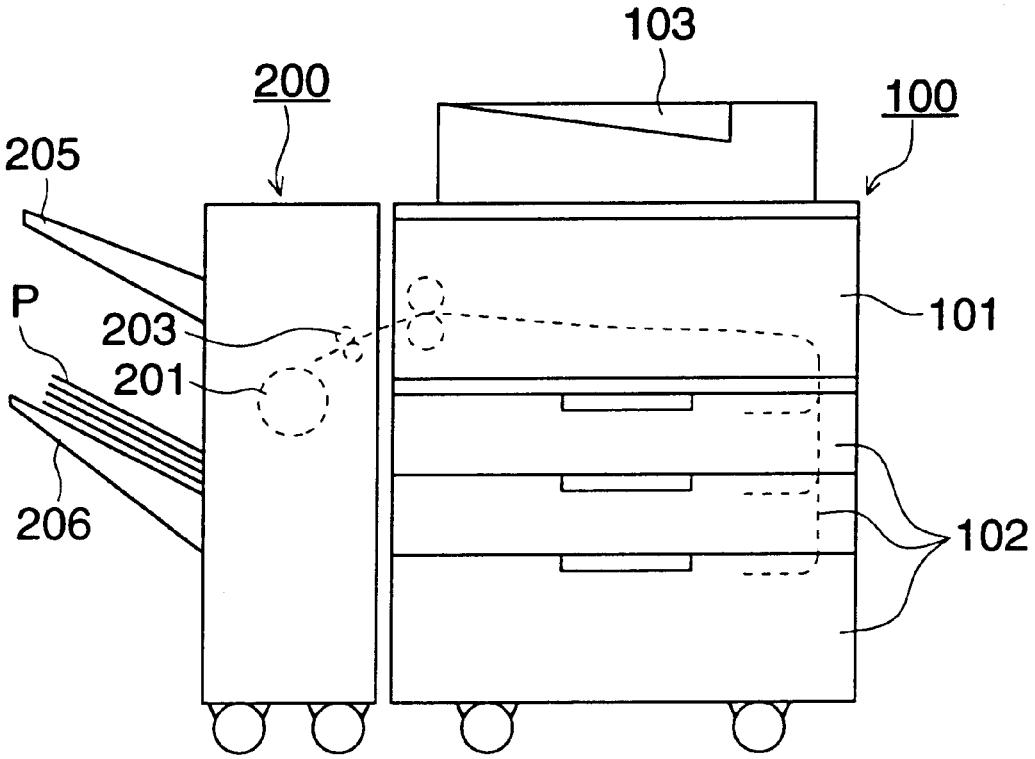
FIG. 1 is an outline view of a copier 100 in which a sheet conveying apparatus of the present invention is used.

A pair of conveyance rollers 203 are fixed on a driving shaft 223, and are driven by a motor M1 through gears G2 and G4.

A reversing drum 201 is fixed on a driving shaft 207, and is driven by a motor M2 through gears G0 and G1. An encoder 209 is fixed on the driving shaft 207, and the rotation of the encoder 209 is detected by a rotation sensor 210, and the rotation of the reversing drum 201 is controlled according to the detection signal.

A movable holding member 400 and fixed holding member 401, which hold the recording sheet P by nipping the leading edge of the recording sheet P, are provided on the outer periphery of the reversing drum 201. When the movable holding member is positioned at a position shown in FIG. 2, that is, in the vicinity of the uppermost position of the reversing drum 201, the movable holding member 400 is rotated to an opened position, which is protruded from the drum surface, and enters a state which can receive a conveyed recording sheet. When the reversing drum 201 is rotated and displaced, the movable holding member 400 is rotated to a position almost conforming to the drum surface, which is a closed position, and holds the recording sheet P by nipping it between the fixed holding member 401 and the movable holding member 400 itself. Recording sheet conveyance driving rollers 215 and 216 are provided above the reversing roller 201, and driven rollers 213 and 214 are provided corresponding to recording sheet conveyance driving rollers 215 and 216, and receive and convey the recording sheet conveyed from the conveyance roller pair 203.

Figure 3:
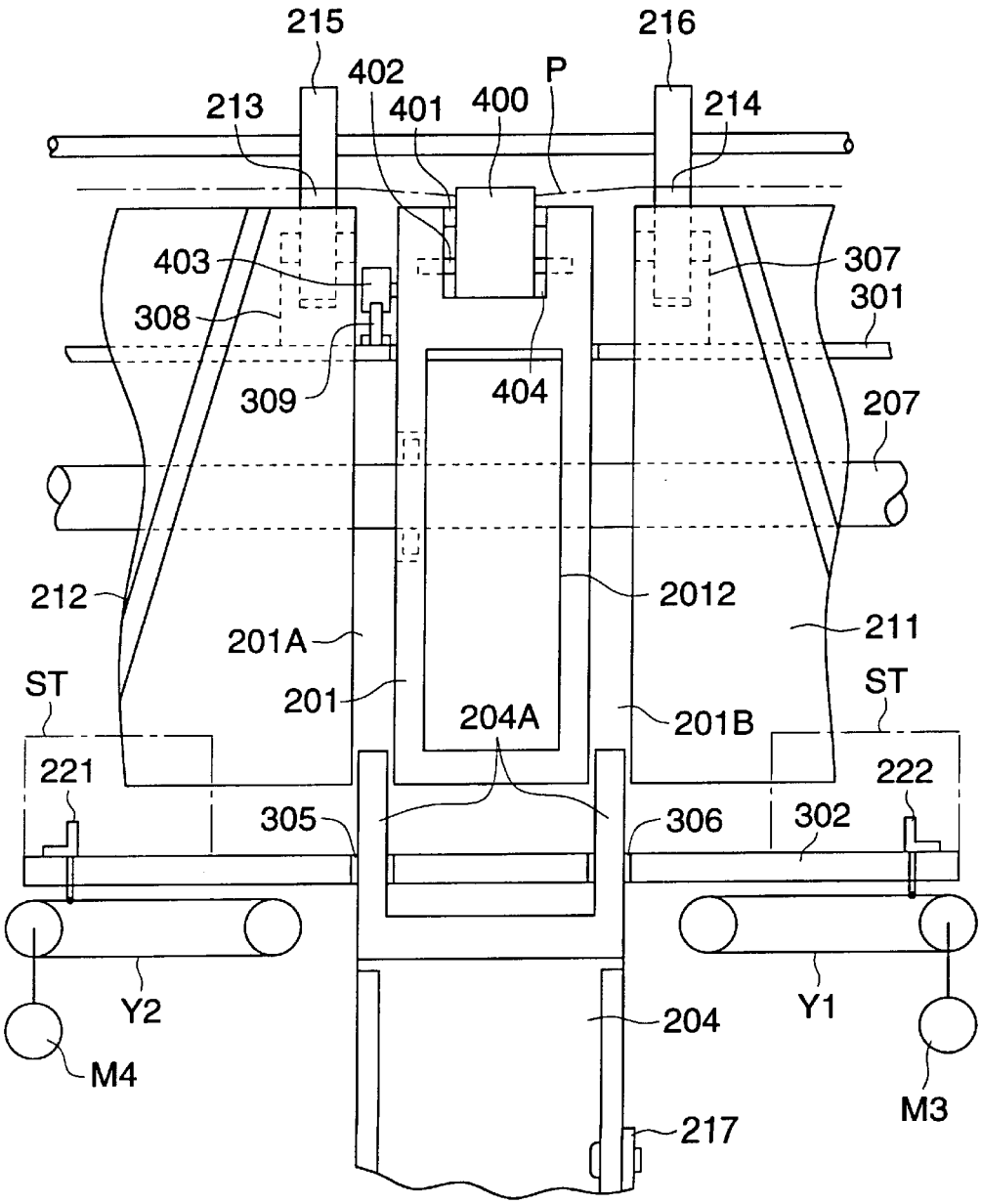
FIG. 3 is a side view of the recording sheet processing apparatus shown in FIG. 2.

On both sides of the reversing drum 201, guide plates 211 and 212 are provided, each of which has a recording sheet guiding surface having almost the same shape as the conveyance surface of the reversing drum 201. A stacking table 302 on which conveyed recording sheets are stacked, is provided below the reversing drum 201. Cutouts 305 and 306, in which a recording sheet stopping arm 204A reciprocates, are provided on the stacking table 302. Further, on the stacking table 302, openings 303 and 304 perpendicular to the recording sheet conveyance direction are provided. From these openings 303 and 304, position regulating members 221 and 222 to set the recording sheet running position, that is, to set the position in the width direction of the conveyance path, are protruded, and the side positions of the recording sheet P are regulated. The position regulating members 221 and 222 are respectively fixed to wires Y1 and Y2 driven by motors M3 and M4, as shown in FIG. 3, and driven by motors M3 and M4, and respectively moved in the openings 303 and 304.

Referring to a side view in FIG. 3 and sectional views in FIGS. 4 and 5, the structure of the recording sheet processing apparatus 200 will be described below.

On both sides of the reversing drum 201, guiding plates 211 and 212 are provided with several length of gaps 201A and 201B between both plates. A cam 309 is fixed on a fixed supporting plate 301 in the gap 201A, and an operating roller 403 of the movable holding member 400 contacts the cam 309. The movable holding member 400 is rotatable around a shaft 402, and is urged clockwise in FIG. 4 by a spring SP. When the movable holding member 400 is located at the position shown in FIG. 4, the operating roller 403 rises on the cam 309. In this case, the movable holding member 400 is at the position rotated counterclockwise against the urging force of the spring SP, and protruded from the peripheral surface of the reversing drum 201. When the reversing drum 201 is rotated counterclockwise from the position shown in FIG. 4 and the operating roller 403 is separated from the cam 309, then, the movable holding member 400 is rotated clockwise by the urging force of the spring SP, comes into pressure-contact with the fixed holding member 401, and is turned to a state to hold the recording sheet P.

Figure 5:
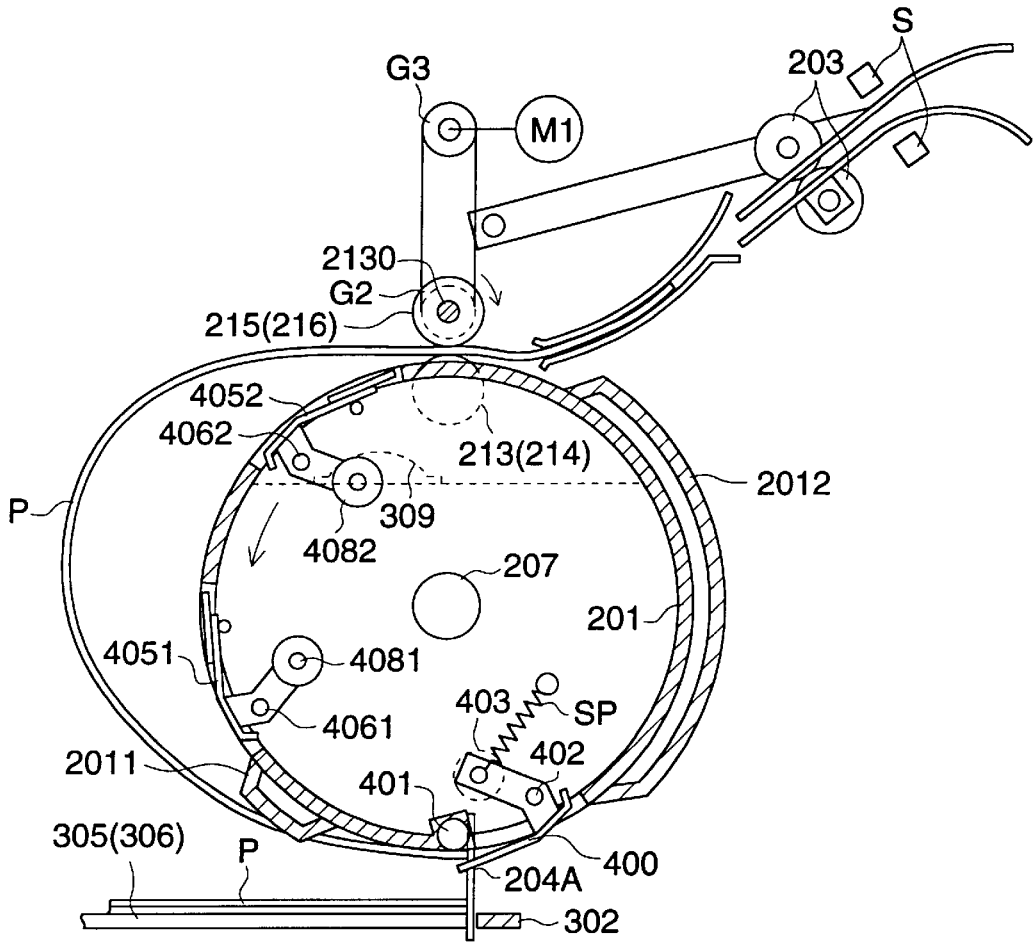
FIG. 5 is a sectional view of the recording sheet processing apparatus shown in FIG. 2 in a state in which the recording sheet is reversed.

When the reversing drum is further rotated and the leading edge of the recording sheet P reaches the lowermost position as shown in FIG. 5, the running of the leading edge of the recording sheet P is blocked by the recording sheet stopping arm 204A of a delivery member 204. The rotation of the reversing drum 201 is continued, and the reversing drum 201 receives the recording sheet P conveyed from the conveyance roller pair 203, and the recording sheet P is reversed and successively stacked on the stacking table 302.

As shown in FIG. 3, staplers ST are provided on both ends in the width direction of the recording sheet conveyance path of the stacking table 302, driven by a motor, not shown, and moved corresponding to sizes of the recording sheets. The stacked recording sheets P are stapled by the staplers ST.

Figure 4:
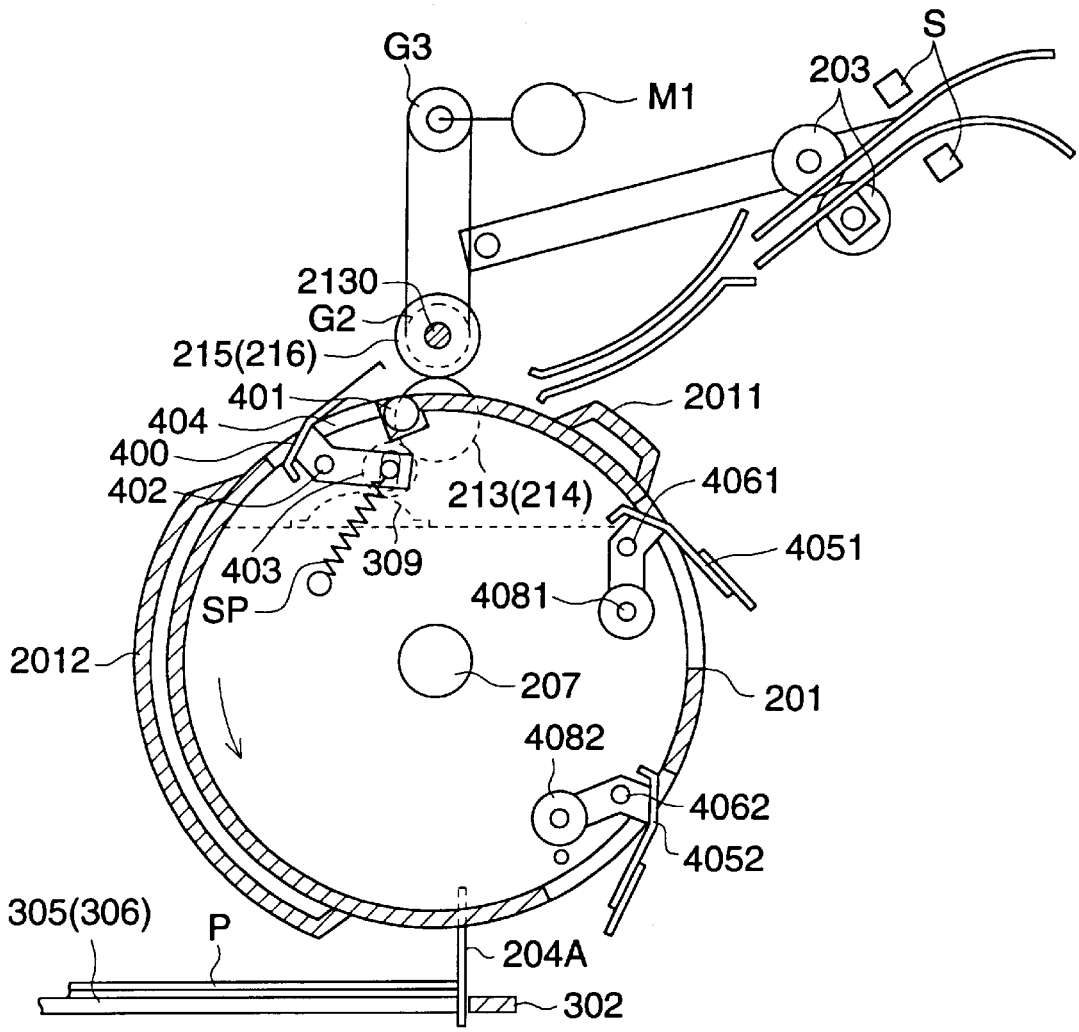
FIG. 4 is a sectional view of the recording sheet processing apparatus shown in FIG. 2 in a state in which the recording sheet is received.
Figure 6:
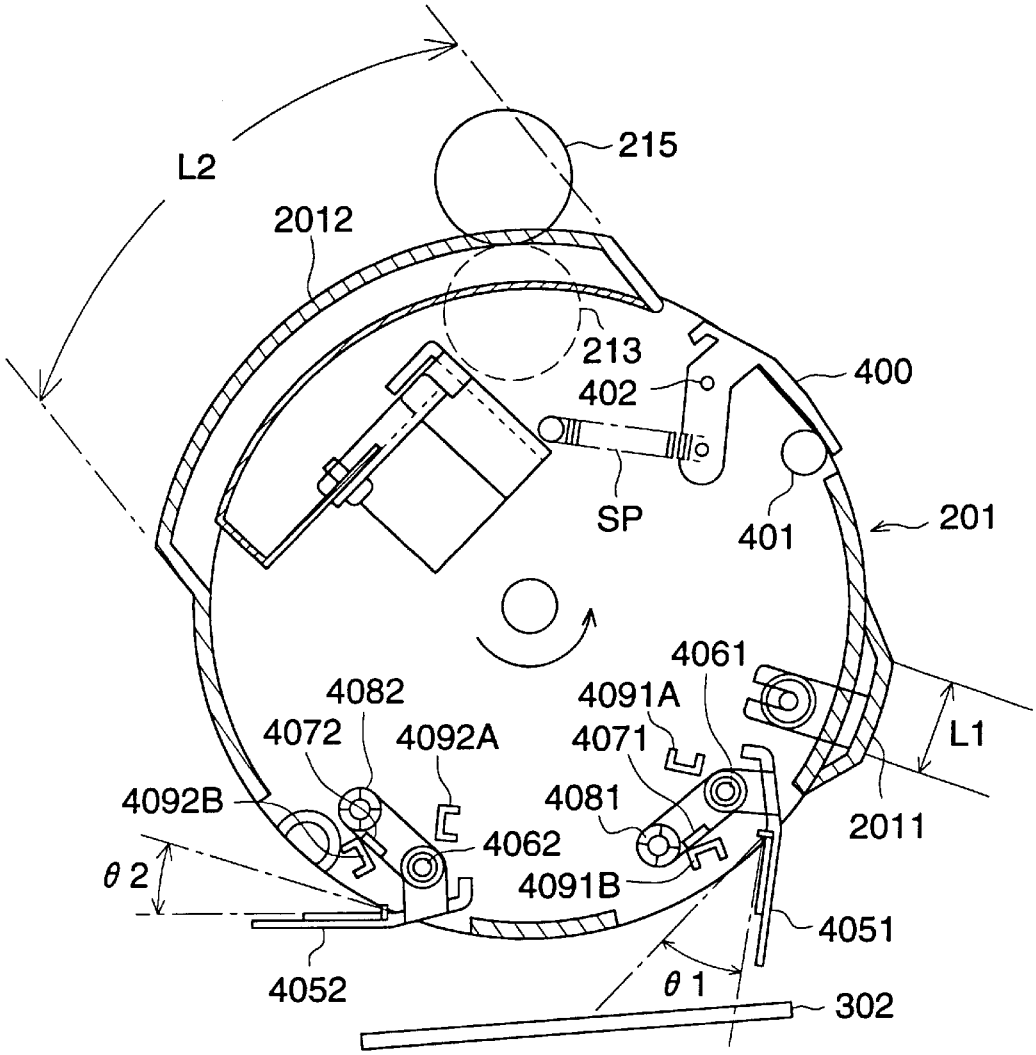
FIG. 6 is a sectional view of a reversing drum in the recording sheet processing apparatus shown in FIG. 2.

The delivery member 204 reciprocates in the cutouts 305 and 306 provided on the stacking table 302 by a crank 218 rotated by a motor, not shown, and delivers the recording sheets P, which are stacked on the stacking table 302 and stapling processed, to the left direction in FIGS. 4, 5 and 6. The delivered recording sheets P are stacked on a reversed delivery sheet tray 206.

Referring to FIG. 6, the structure of the reversing drum 201 will be detailed below.

A protruded portion 2011 having a guide surface which is higher than the peripheral surface of the drum (several mm higher than the peripheral surface of the drum), is formed at a position close to the movable holding member 400 on the upstream side of the movable holding member 400, in the rotational direction of the drum, and the almost same protruded portion 2012 is formed at a position apart from the movable holding member 400. The protruded portion 2011 suppresses floating of the leading edge portion of the sheet P in the vicinity of the stopping arm 204A, and prevents the leading edge of the sheet P from floating and bending due to impact at stopping, and being disordered, when travelling of the sheet P is blocked by the stopping arm 204A.

Figure 8:
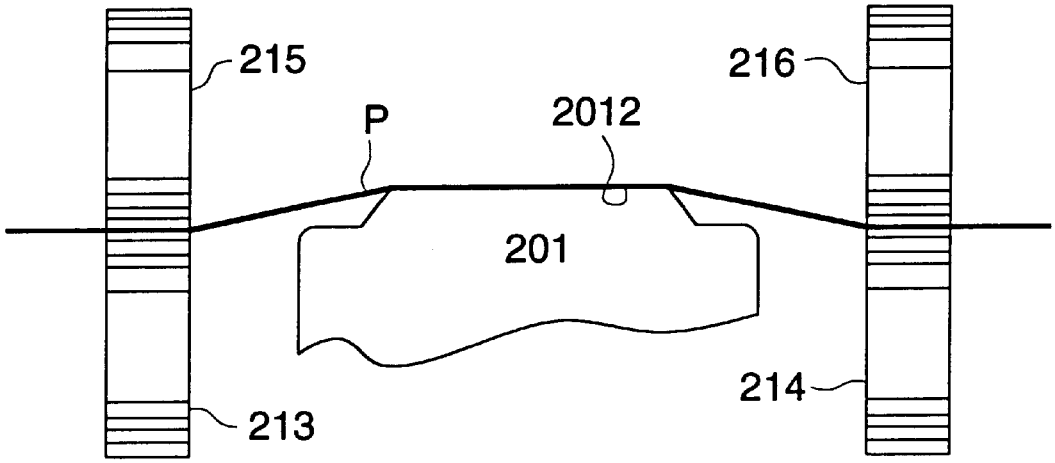
FIG. 8 is a view showing a state in which the recording sheet is held before the recording sheet is reversed in the recording sheet processing apparatus shown in FIG. 2.

As shown in FIG. 8, the height of a portion supported by the reversing drum 201 is different from that of portions nipped by a pair of the conveying roller 215 and the follower roller 213 and a pair of the conveying roller 216 and the follower roller 214. Thereby, the protruded portion 2012 provides wave-like bending to the conveying sheet P so that the sheet P has stiffness, thereby, the protruded portion 2012 enhances the straight advancing property of the sheet P, so that the sheet P can be securely reversed. The protruded portion 2011 may only press the leading edge portion of the sheet P, and therefore, its length L1 in the rotational direction may be comparatively short. However, it is necessary for the protruded portion 2012 to securely reverse various sizes of sheets. Accordingly, the length L2 in its rotational direction is comparatively long. That is, preferably $L1<L2$.

Oscillation members 4051 and 4052 are provided in the reversing drum 201. The oscillation member 4051 is rotatably provided on a shaft 4061, and has a portion protruded from the peripheral surface of the reversing drum 201. A weight 4081 is provided on the opposite side of the protruded portion. In the same manner, the oscillation member 4052 is rotatably provided on a shaft 4062, and a weight 4082 is provided on the opposite side of the protruded portion with the shaft 4062 between them. Numerals 4091A and 4091B are stoppers to limit the oscillation angle range of the oscillation member 4051, and numerals 4092A and 4092B are stoppers to limit the oscillation angle range of the oscillation member 4052.

The positional relationship of the oscillation member 4051 to the stopper 4091B and the positional relationship of the oscillation member 4052 to the stopper 4092B are set as follows. That is, as shown in FIG. 6, under the condition that the oscillation members 4051 and 4052 respectively contact with stoppers 4091B and 4092B, and the protruded portion is positioned in the extremely opened position, the stoppers 4091B and 4092B are formed in such a manner that angles $\theta 1$ and $\theta 2$, formed between the protruded portions of the oscillation members 4051,4052, and tangential lines on the peripheral surface of the reversing drum 201 at the protruded portions, have the relationship of θ1>θ2. When the stoppers 4091B and 4092B are formed as described above, the sheet P is regulated comparatively strongly by the oscillation member 4051 which initially acts upon the sheet P, the leading edge of the recording sheet comes into contact with the stopping arm 204A, and the regulation force of the oscillating member 4052 which acts succeedingly upon the sheet, is made comparatively weak. Thereby, the leading edge portion is not bent at the stopping arm 204A position, the leading edge of the sheet P is aligned, and the sheet P is stacked on the stacking table 302.

The oscillation members 4051 and 4052 operate as follows. In FIG. 6, when the oscillation members 4051 and 4052 stand at angular positions corresponding to 7 to 3 o'clock of the clock, both the weights 4081 and 4082 are positioned left with respect to shafts 4061 and 4062, provide moment to the oscillation members 4051 and 4052 so as to rotate the oscillation members 4051 and 4052 counterclockwise, the oscillation members 4051 and 5052 are respectively rotated counterclockwise, and contact portions 4071 and 4072 are in contact with the stoppers 4091B and 4092B, or in proximity to them.

According to the counterclockwise rotation of the reversing drum 201, the rotation moment generated by weights 4081 and 4082, is decreased, the oscillation members 4051 and 4052 are gradually closed, and rotated to the position at which these members form the surface, which coincides with the peripheral surface of the reversing drum. While oscillation members 4051 and 4052 are located at a position between about 11 and 6 o'clock of the clock, this condition, that is, the condition that the contact members 4071 and 4072 are in contact with stoppers 4091A and 4092A, and the oscillation members 4051 and 4052 are closed, is maintained. Corresponding to advancing of the rotation of the reversing drum, the oscillating members 4051 and 4052 are oscillated when weights 4081 and 4082 are moved from the right side of shafts 4061 and 4062 to the left side, and are quickly rotated counterclockwise, and protrude from the peripheral surface of the reversing drum 201. This protruding operation is carried out when the oscillation members 4051 and 4052 pass the position close to the stacking table 302, and the right end of sheet P contacts with the stopping arm 204A and is aligned while the sheet P is being pressed on the stacking table 302.

Figure 7:
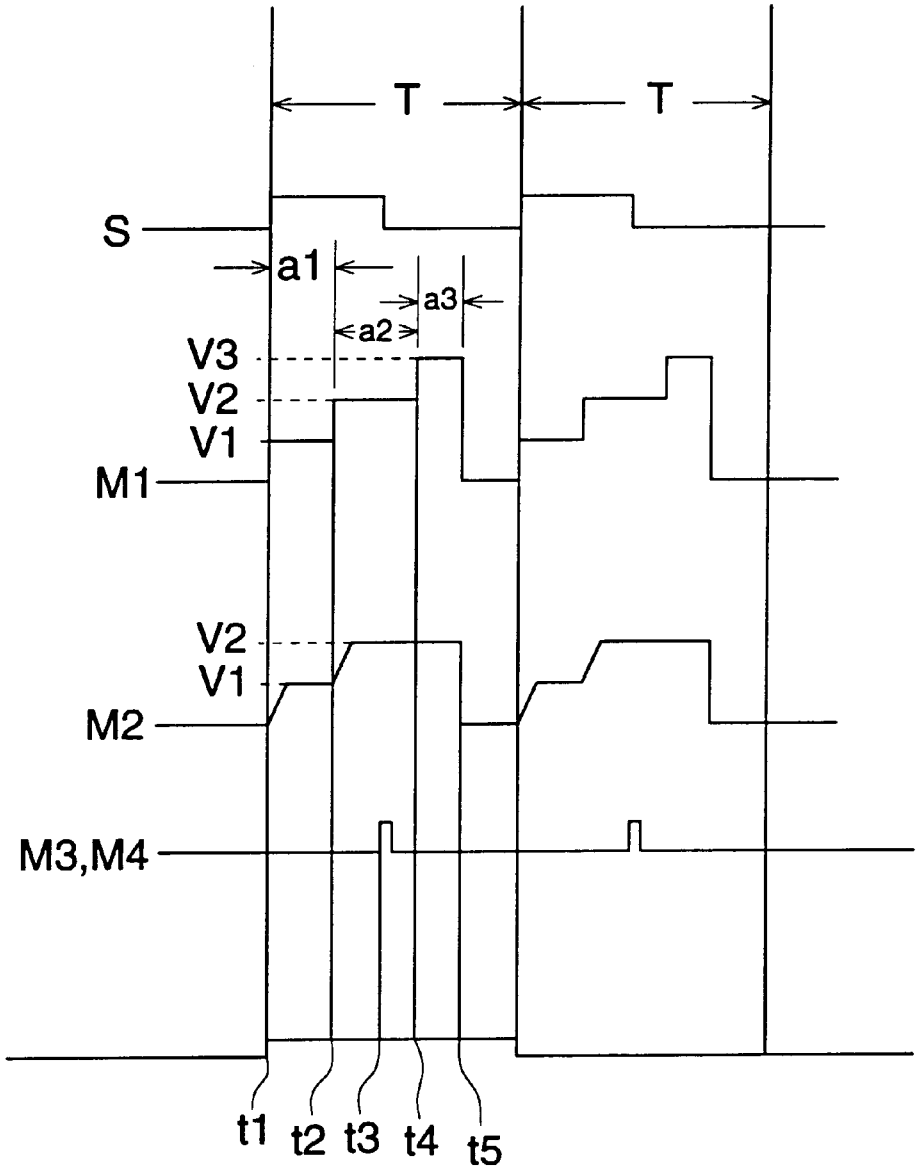
FIG. 7 is a time chart for explaining operations of the recording sheet processing apparatus shown in FIG. 2.

Next, operations of thee above cited recording sheet processing apparatus will be described. FIG. 7 is a time chart of the operations of the recording sheet processing apparatus.

Motors M1 and M2 are activated by a signal of a recording sheet sensor S provided near a recording sheet receiving opening of the recording sheet processing apparatus 200, which detects the leading edge of the recording sheet P, that is, by a signal rising at the time t1, and the conveying roller pair 203 and recording sheet conveying rollers 215 and 216 start the rotation. At the time of start of the rotation of the reversing drum 201, the movable holding member 400 and the fixed holding member 401 are positioned on an upstream side of the uppermost position of the reversing drum 201. Waiting positions of the holding members 400 and 401 at the time of the start of rotation of the reversing drum 201 are set so that the holding members 400 and 401 reach the position of the recording sheet conveying roller 215 in timed relationship with the movement of the leading edge of the recording sheet P from the position of the conveying roller pair 203 to the position of the recording sheet conveying rollers 215 and 216.

At the time when the recording sheet P reaches the top position of the reversing drum 201, the leading edge of the recording sheet P and holding members 400 and 401 move at the same speed, the movable holding member 400 is rotated from the opened position protruded from the peripheral surface of the drum to the closed position which forms almost the same surface as the peripheral surface of the drum, by the operation of the cam 309, and the leading edge of the recording sheet P is held by the holding members 400 and 401. The motor M1 and motor M2 are rotated at low speed v1 as shown in the drawing, at the timing al when the recording sheet holding operation is conducted. Such the low speed is for the reason that the reliability of the recording sheet holding operation is ensured.

Next, the speed of the motor M1 and motor M2 is increased to conveying speed v2 at the time t2. This increase of speed is conducted at the timing a2 to assure the reversing of the recording sheet P by conveying the recording sheet P at high speed, in addition to the intention of increasing the processing speed. After that, rotation of the motor M at the speed v2 is maintained, and the reversing drum 201 continues the rotation at the constant speed, then, speed of the motor M1 is increased to higher speed v3 at the time t4. According to this increase of speed, the trailing edge portion of the recording sheet P is conveyed at the higher speed than that of the leading edge portion, and reversing of the recording sheet P is assuredly conducted. The speed of the motor M1 is increased to v3 at the timing a3 at which the leading edge portion of the recording sheet P reaches the lower portion of the reversing drum 201. The oscillation member 4051 in this state, passes over the stacking table 302, and operates so that the leading edge of the recording sheet P comes into contact with the recording sheet stopping arm 204A.

The recording sheet reversing operation as described above is repeated at each period of T, and the recording sheets P are stacked on the stacking table 302. As already described above, the leading edge of the stacked recording sheets P is aligned at the position of the recording sheet stopping arm 204A and the recording sheets P are stacked on the stacking table.

The recording sheet conveying speed v1, v2, and v3 are respectively set to, for example, 210 mm/sec, 630 mm/sec, and 1200 mm/sec.

The position alignment of the recording sheet P in the direction perpendicular to its moving direction is conducted by regulating members 221 and 222, and the recording sheet alignment operation by the regulating members 221 and 222 is conducted at the time t3 at which the leading edge of the recording sheet is stopped by the recording sheet stopping arm 204A and is separated from the holding members 400 and 401.

(2) Antistatic of the recording sheet

In the above cited recording sheet reverse processing apparatus, the recording sheet is reversed and stacked on the stacking table 302, and in this case, there is a problem that the recording sheet is hardly aligned by its static charge. As described above, the leading edge portion of the recording sheet is aligned by the protruded portion 2011 and oscillating members 4051 and 4052, however, the following tendency becomes clear: the trailing edge of the recording sheet comes into a floating state or is horizontally shifted, resulting in misalignment by the electrostatic force due to static charge of the recording sheet P. It is considered that such the phenomenon attributes to charge mainly caused by peeling of the trailing edge from the reversing drum 201 when the recording sheet P is reversed. As the result of various experiments, such the misalignment in the delivery sheet section can not be sufficiently prevented by bringing the discharging brush into contact with the recording sheet as the conventional application.

In the present invention, by adopting a antistatic means shown in FIGS. 9(*a*) and 9(*b*), the above cited misalignment of the recording sheet in the delivery sheet section can be prevented.

Figure 2:
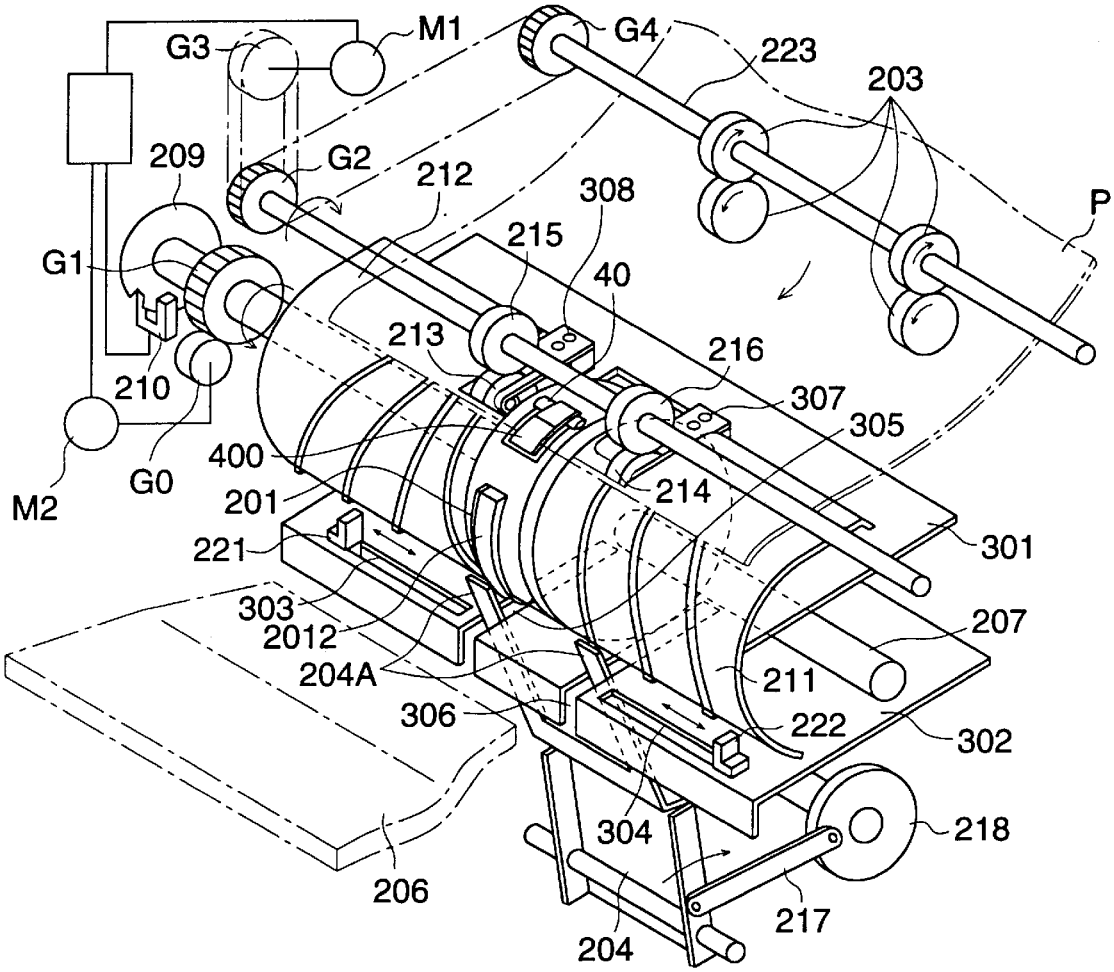
FIG. 2 is a perspective view of a recording sheet processing apparatus in which the sheet conveying apparatus according to an example of the present invention is mounted.

FIGS. 9(*a*) and 9(*b*) are a plan view and a sectional view of the recording sheet guiding plates 211 and 212 shown in FIGS. 2 and 3, which are developed into a plane.

Numerals 211*a* and 212*a* are respectively conductive substrates such as steel plates, aluminum plates, or plastic plates on which the conductive layer is laminated, and are electrically grounded to discharge absorbed electric charges. Numerals 211*b* and 212*b* are respectively discharging layers and are structured by organic conductive fibers. The discharging layers have conductivity, and are layers having the characteristic in which not only the layer itself is not electrically charged but it also prevents the material, in contact with or in close proximity to the discharging layers 211*b* and 212*b*, from being electrically charged. Specifically, the layers are excellent in the function to discharge the material in no-contact with and in close proximity to the discharging layers 211*b* and 212*b*.

The discharging effect by the discharging layers 211*b* and 212*b* is obtained by the following method, which is a characteristic of the present invention: the discharging operation is not carried out by bringing the discharge layer into linear contact with the recording sheet like as the discharging brush which is the conventional discharging means, but the discharging operation is carried out by making the discharging layer in close proximity to the recording sheet in a surface-like manner. That is, the discharging layers 211*b* and 212*b* are, as shown in 9(*a*) and 9(*b*), in close proximity to the recording sheet P like as a surface having a considerable length not only in the width direction perpendicular to the conveying direction X of the recording sheet, but also in the conveying direction shown by X, and discharge the recording sheet P.

As the discharging layer having the above cited discharging performance, organic conductive fibers having the specific resistance of $10^{-5}$ to $10^{-1}$ Ω·cm are preferable. If the specific resistance is larger than $10^{-1}$ Ω·cm, the discharging performance is lowered, and antistatic becomes difficult. The Thunderon or Thunderon Super produced by Nihon Sanmo Dyeing Co., Ltd. is appropriate for the material of the above cited discharging layer. These products are nonwoven fabric formed of organic conductive fibers produced by connecting copper sulfide to acryl or nylon, and have excellent conductivity.

Numerals 211*c* and 212*c* are ribs to form the recording sheet conveying surface in close to the upper surface of the discharging layers 211*b* and 212*b*. The thickness of the ribs 211*c* and 212*c* is preferably about 2 to 10 mm. By the ribs 211*c* and 212*c*, practically, the recording sheet conveying surface to hold the recording sheet to be in no-contact with the discharging layers 211*b* and 212*b* is formed, and the recording sheet is discharged.

The ribs 211*c* and 212*c* are arranged such that they are angled outward from a center line parallel to the conveying direction X of the recording sheet as shown in the drawing. In also the space between ribs, the ribs 211*c* and 212*c* are arranged such that the space d2 at the downstream side is larger than the space d1 at the upstream side. By such the arrangement of the ribs 211*c* and 212*c*, the guiding surface corresponding to various sizes of recording sheets is formed by comparatively small number of ribs; the operation of skewing the recording sheet by the ribs 211*c* and 212*c* against the outside edge of the conveyed recording sheet is prevented, thereby, skewing and corrugating of the conveyed recording sheet are prevented.

By using the guiding plates 211 and 212 as described above, the above described misalignment of the recording sheet P in the delivery sheet section is prevented, thereby, the recording sheets P can be delivered on the stacking table 302 in good order.

EXAMPLE

As the guiding plates of the recording sheet reverse processing apparatus shown in FIG. 2, the following members are used.

Grounded processed steel plate representing conductive substrate (211*a*, 212*a*); Thunderon (produced by Nihon Sanmo Dyeing Co., Ltd.) having 1 mm thick, and specific resistance of $10^{-2}$ Ω·cm representing discharging layer (211*b*, 212*b*); and nylon rib having 2 mm thick, and 5 mm width representing rib (211*c*, 212*c*), are used.

Thunderon is fixed by adhering its periphery onto respective conductive substrates 211*a* and 212*a* by a two side adhesive tape, and the discharging layers 211*b* and 212*b* are formed. Both ends of ribs 211*c* and 212*c* are fastened thereon, thereby the ribs are fixed. As described above, ribs 211*c* and 212*c* form the recording sheet conveying surface closed to the surface of the discharging layers 211*b* and 212*b* thereon. Ribs 211*c* and 212*c* press the discharging layers 211*b* and 212*b* so that the discharging layers are in contact with the conductive substrates 211*a* and 212*a* all over the surface, and contribute for the discharging layers to form the electric connection for discharging the electric charges absorbed from the recording sheets P.

By using the recording sheet guiding plates 211 and 212 as described above, the misalignment of the recording sheets P in the delivery sheet section due to the charge of the recording sheets P is very effectively prevented.

According to the present invention, static charge of the recording sheet is prevented, thereby, conveyance failure is dissolved. Static charge of the recording sheet in the delivery sheet section is very effectively prevented, thereby, misalignment of the recording sheets in the delivery sheet section in the reverse processing apparatus is cleared away.

What is claimed is:

1. A sheet conveyance apparatus comprising:

a guide for a recording sheet, having a cylindrically curved surface in close proximity to a surface of the recording sheet, along a convex surface over which recording sheet is guided and, thereafter, from which the recording sheet is separated so as to be reversed, aligned, and then stacked, wherein said guide includes a discharging layer having an electrically grounded conductive substrate, an organic conductive fiber on the conductive substrate, and a support provided on the convex surface of the discharging layer, which supports and guides the recording sheet without bringing the recording sheet into contact with the discharging layer, the support being on a same side of said recording sheet as the convex surface of said discharging layer.

2. The sheet conveyance apparatus of claim 1 wherein the support is a rib.

3. The sheet conveyance apparatus of claim 2 wherein the rib is oblique with respect to a conveyance direction of the recording sheet.

4. The sheet conveyance apparatus of claim 3 wherein the rib includes a plurality of ribs, each distance between adjacent said ribs being greater on a downstream side than on an upstream side relative to said conveyance direction of the recording sheet.

5. The sheet conveyance apparatus of claim 1 further comprising a reversing element having a reversing section for inverting the recording sheet, wherein the guide is on the reversing section.

6. The sheet conveyance apparatus of claim 1 wherein the organic conductive fiber has a specific resistance of $10^{-5}$ to $10^{-1}$ Ω·cm.

7. A sheet conveyance apparatus of claim 14 wherein the rib has thickness of 2 to 10 mm.

8. A sheet conveyance method comprising:

moving a recording sheet toward a discharging layer, which layer includes an electrically grounded organic conductive fiber, so that a cylindrically curved surface of the discharging layer is in close proximity to a surface of the recording sheet;

supporting the recording sheet by a support provided on a convex surface of the discharging layer, the support being on a same side of the recording sheet as the convex surface of the discharging layer;

guiding the recording sheet along the support without bringing the recording sheet into contact with the discharging layer, separating the recording sheet from the convex surface of the discharging layer so as to be reversed; and then aligning and stacking the recording sheet.

9. The sheet conveyance method of claim 8 wherein said recording sheet is supported by a rib disposed on the discharging layer.

10. The sheet conveyance method of claim 8 wherein the organic conductive fiber has a specific resistance of $10^{-1}$ to $10^{-5}$ Ω·cm.

* * * * *